United States Patent [19]

Ritchie

[11] 4,328,687

[45] May 11, 1982

[54] LOCKING DEVICE

[76] Inventor: Ian C. Ritchie, 55 Barmah St., Mt. Eliza, Victoria, Australia

[21] Appl. No.: 57,845

[22] Filed: Jul. 16, 1979

[30] Foreign Application Priority Data

Jul. 31, 1978 [AU] Australia ..... PD5300

[51] Int. Cl.[3] ..... E05B 73/00

[52] U.S. Cl. ..... 70/34; 70/58; 70/DIG. 57

[58] Field of Search ..... 70/57, 58, 32, 33, 34, 70/DIG. 57, 61, 62; 248/551, 553; 211/4, 8, 64

[56] References Cited

U.S. PATENT DOCUMENTS

| | | | |
|---|---|---|---|
| 587,821 | 8/1897 | Hodgson | 70/DIG. 57 |
| 1,424,686 | 8/1922 | Somers | 70/DIG. 57 |
| 2,664,658 | 1/1954 | Bjorklund | 70/58 |
| 3,637,180 | 1/1972 | Parry | 248/203 |
| 4,182,453 | 1/1980 | Worswick | 211/4 |

FOREIGN PATENT DOCUMENTS

| | | | |
|---|---|---|---|
| 2425386 | 4/1975 | Fed. Rep. of Germany | 70/34 |
| 7712925 | 11/1977 | Sweden | 70/34 |

*Primary Examiner*—Robert L. Wolfe

*Attorney, Agent, or Firm*—Eyre, Mann, Lucas & Just

[57] ABSTRACT

Locking device for securing a firearm to a wall, having a first part securable to the wall and a second part insertable through the trigger guard of the firearm to be engaged with the first part, the second part being so shaped as to then retain the firearm on the wall. The second part has a shank portion which enters into an opening in the first part and a lock is provided operable to hold the shank when so entered. The first part is securable to the wall by screws passing through screw holes in the first part, which screw holes are selectively exposable by rotating a cover plate on the first part to align an opening in the cover plate with the screw holes. When the second part is locked to the first part the shank passes through the cover opening into the second part to lock the cover against rotation so that it cannot be rotated to a position giving access to the screw holes.

7 Claims, 6 Drawing Figures

LOCKING DEVICE

BACKGROUND OF THE INVENTION (i) Field of the Invention

This invention relates to a locking device particularly for use in conjunction with a holding device for firearms so that when a firearm is positioned on the holding device it can be secured against removal by use of the locking device.

BRIEF DESCRIPTION OF THE INVENTION

The invention broadly contemplates a locking device comprising a first part securable to a wall or other fixture and a second part which is releasably retainable by the first part and is so shaped that when so retained, and the first part is secured to said fixture, the second part can extend through the trigger guard of a firearm to secure the firearm to the fixture. In a preferred form, the first part includes a casing securable to the fixture and having a first opening therein, the second part including an elongate shank with an enlarged head portion at one end, a free end of the shank remote from the head portion being passable through the said trigger guard and receivable in the said first opening in the first part, a latch being provided for releasably latching the so received said free end to the first part so that, when the first part is mounted on the said fixture and the shank portion passed through the trigger guard and latched to the first part, the enlarged head portion prevents removal of the firearm from the fixture. The latch may be key actuable and may include a lever which is pivotal by key freed actuation to engage the free end of said shank to prevent withdrawal of the shank from the first part. The shank may, for example, have a groove in its side surface which is engaged by the said lever for this purpose.

In the preferred embodiment the first part has a disc with an eccentric second opening therethrough and mounted for axial rotation relative to the casing of the first part to align the second opening with the first opening in the said casing so that the shank can pass through the so aligned openings for operation of the device. In this instance, said second opening or a further opening in the disc is positioned so that when the first and second parts are not engaged, the second or further opening can be aligned by rotating the disc so as, in use of the device where it is secured to said fixture, to permit access to screws or other fastening devices which secure the first part to said fixture; said access being prevented by the disc when the disc is positioned with said first and second openings aligned.

BRIEF DESCRIPTION OF THE SEVERAL VIEWS OF THE ACCOMPANYING DRAWINGS

DETAILED DESCRIPTION

Figure 1:
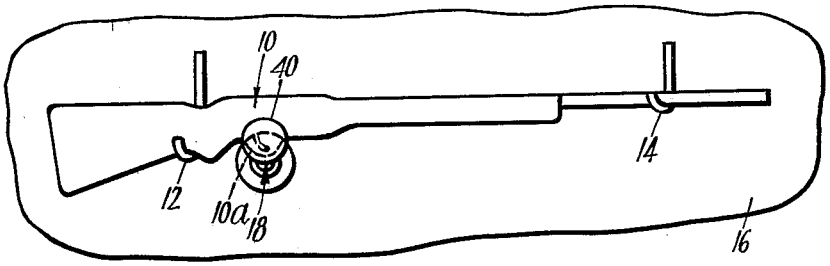
FIG. 1 is a partly diagrammatic view of a firearm secured to a firearm rack and locked in position by the use of a device constructed in accordance with the invention.
Figure 2:
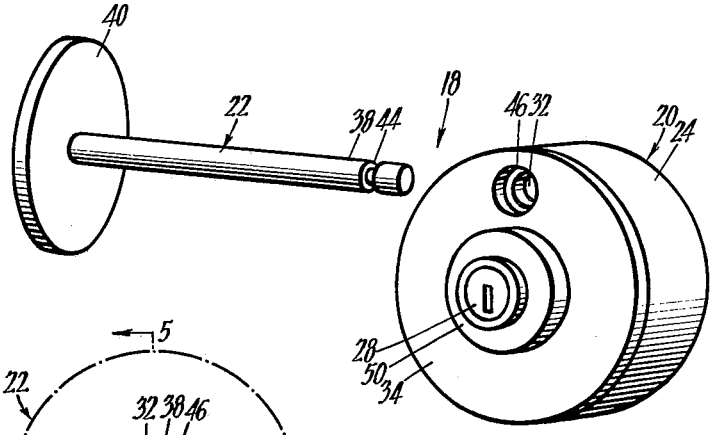
FIG. 2 is a perspective view of the device of the invention with two parts thereof disassembled.

In FIG. 1 a firearm 10 is shown mounted on a rack including two hook-like elements 12, 14, secured to a wall 16, the stock of the firearm resting on element 12 and the barrel of the firearm resting on element 14. The firearm is locked to the wall by means of a device 18 now described.

Device 18 includes a first part 20 and a second part 22. Part 20 includes a shallow hollow cylindrical body 24 closed at one end by a transverse wall **24*a*, and open at the other end. Body 24 is secured to wall 16, with wall 24*a* outermost, by two screws 26 which pass through respective openings 24*b* in wall 24*a*. Openings 24*b*** are equispaced on a common pitch circle.

A cylinder lock 28 is secured to wall **24*a* so as to extend therethrough, with a forward key-receiving end projecting from the wall 24*a* and a rear end extending within the body 24. The lock is held in position by a locking washer 35 and a nut 40, which nut is threadedly engaged on a threaded part 28*a* at the rear end of the lock. The threaded part 28*a* passes first through a central opening 50*a* in a flanged member 50 and then through a central opening 37 in wall 24*a* so as to project into the interior of body 24. In this condition, as shown, an outwardly extending peripheral flange 28*a* at the outer end of lock 28 bears against an outer axial end of member 50, whilst the inner end of member 50 bears against the outer surface of wall 24*a*. Nut 40 is tightened on the inner end of threaded part 28*a* to press the washer 35 against the inner surface of wall 24*a*, to tightly secure the lock to the wall and, at the same time, to clamp and hold the member 50 in position interposed between the outer surface of wall 24*a* and the flange 28*b***.

Figure 3:
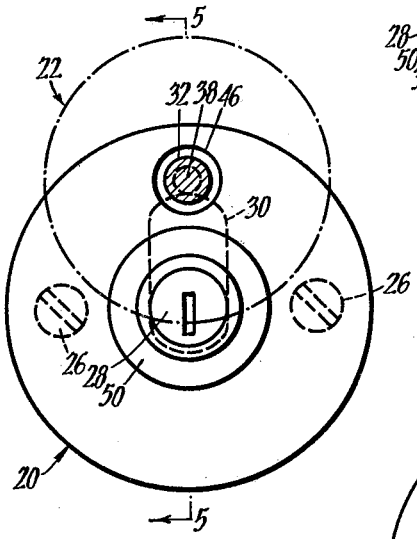
FIG. 3 is a plan view of a first part of the device of the invention, with two components thereof in a first state of alignment.
Figure 4:
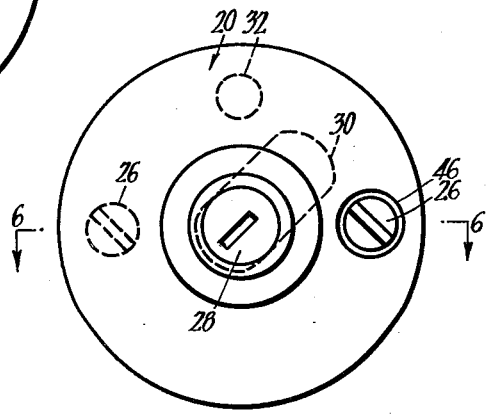
FIG. 4 is a view like FIG. 3 but showing the two components of the first part in a different alignment.

Lock 28 has a radially projecting arm 30 positioned at the inner end of the lock and within body 24, the arm 30 being moveable between the two positions shown by broken lines in FIGS. 3 and 4 respectively when a key is inserted into the lock and turned.

A disc 34 is freely rotatably carried on member 50 and is located on body 24 in front of wall **24*a* and such that, although rotatable relative to the body, it is constrained against axial movement, being positioned between the outer surface of wall 24 and the inner surface of an outstanding peripheral flange 50*b* on the outer end of member 50**.

Wall **24*a* has an opening 32 therethrough spaced away from lock 28, and disc 34 has an opening 46 which is so positioned on the disc that by appropriate rotation of the disc on the body 24 the opening 46 is brought into alignment with the opening 32**.

Part 22 comprises an elongated shank 38 with an enlarged head 40 at one end thereof. The opposite end **38*a* of shank 38 has a peripheral groove 44**.

Figure 5:
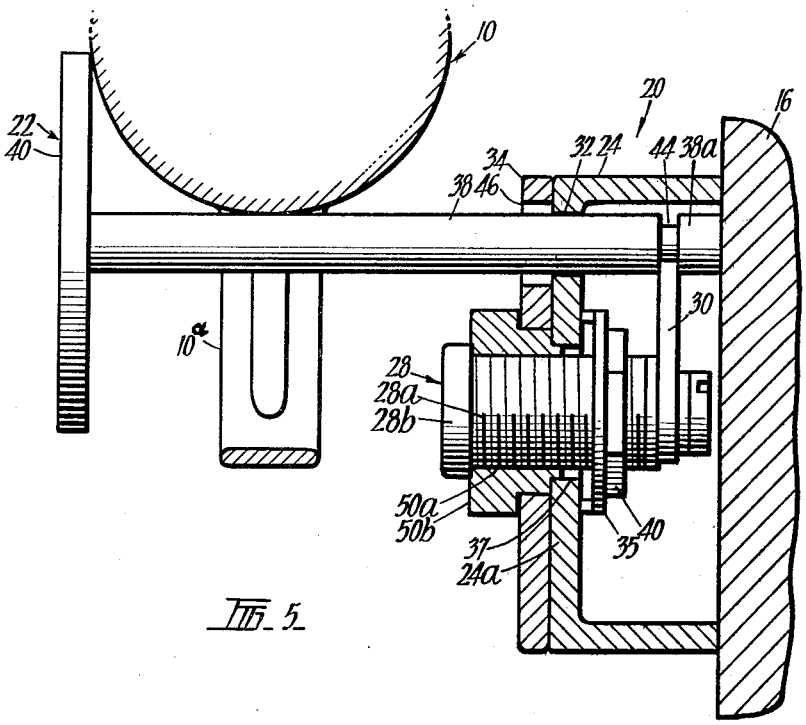
FIG. 5 is a section on the line 5—5 in FIG. 3, with the second part of the device in position.
Figure 6:
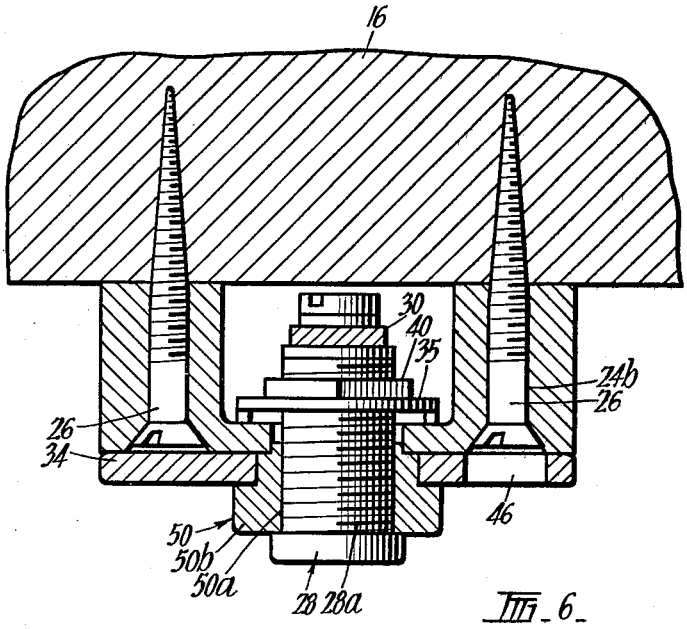
FIG. 6 is a section on the line 6—6 in FIG. 4, with the second part of the device in position.

The end **38*a* of shank 38 can be passed through the openings 32, 46 when aligned and, by appropriate manipulation of lock 28, arm 30 can then be moved to engage the groove 44 (FIG. 3) thereby locking the parts, 20, 22 in the positions shown in FIG. 5, that is to say with shank 38 extending outwardly from wall 24*a* and through body 24 and with head 40 spaced some distance from and generally parallel to wall 24*a*. To facilitate this engagement, the groove 44 is positioned at such a distance from the extremity of end 38***a* that when this extremity abuts wall 16, the groove is axially aligned to receive arm 30. As best seen from FIG. 1, part 20 is secured to wall 16 at a location behind that occupied by the trigger guard 10*a* of the firearm and such that the parts 20, 22 can be engaged and locked together with the shank 38 extending through the trigger guard. Then, the firearm cannot be removed from the rack because it is held in position between the head 40 and wall 16. By unlocking lock 28, arm 30 can be moved to the position shown in FIG. 4 to release the part 22.

In order to prevent unauthorised persons from removing part 20 from wall 16, the disc 34 is shaped to cover the heads of screws 26. However, the screw openings 24*b* are arranged on a common pitch circle with opening 32. Thus the opening 46 can be selectively positioned, by turning the disc 34, to be located over either screw head to permit the screws to be removed or inserted (FIG. 4). Opening 46 is, of course, not so aligned with either of the screw heads when the two openings 32, 46 are aligned (FIG. 3) so that the screws 26 cannot be reached when the parts 20, 22 are engaged.

In a modification of the invention, an aperture separate from opening 46 is provided in disc 34 and positioned to enable access to the screws 26 to be achieved by appropriate turning of disc 34. In this case, the separate aperture and opening are so arranged that the screw heads are not accessible via the separate aperture when the parts 20, 22 are engaged.

The described arrangements has been advanced merely by way of explanation and many modifications may be made thereto without departing from the spirit and scope of the invention as defined in the accompanying claims.

I claim:

1. A locking device comprising a first part securable to a wall or other fixture and a second part which is releasably retainable by the first part and is so shaped that when so retained, and the first part is secured to said fixture, the second part can extend through the trigger guard of a firearm to secure the firearm to the fixture, the first part including a casing securable to the fixture and having a first opening therein, the second part including an elongate shank with an enlarged portion at one end, a free end of the shank remote from the head portion being passable through the said trigger guard and receivable in the said first opening in the first part, a latch being provided for releasably latching the so received said free end to the first part so that, when the first part is mounted on the said fixture and the shank portion passed through the trigger guard and latched to the first part, the enlarged head portion prevents removal of the firearm from the fixture; said latch being key actuatable and includes a lever which is pivotal by key freed actuation to engage the free end of said shank to prevent withdrawal of the shank from the first part; said first part having a disc with an eccentric second opening therethrough for axial rotation relative to the casing of the first part to align the second opening with the first opening in the said casing so that the shank can pass through the so aligned openings for operation of the device, said disc being rotatable to permit the access to screws or other fasteners for securing the first part to said wall or other fixture but prevented from rotation to permit such access when the said shank is positioned to extend through said aligned first and second openings and latched.

2. A locking device comprising a first part securable to a fixture by fastening means and a second part which is releasably retainable by the first part and is so shaped that when so retained, and the first part is secured to said fixture, the second part can extend through the trigger guard of a firearm to secure the firearm to the fixture, the first part including a casing securable to the fixture and having a first opening therein, the second part including an elongate shank with an enlarged head portion at one end, a free end of the shank remote from the head portion being passable through the said trigger guard and receivable in the said first opening in the first part, a latch being provided for releasably latching the so received said free end to the first part so that, when the first part is mounted on the said fixture and the shank portion passed through the trigger guard and latched to the first part, the enlarged head portion prevents removal of the firearm from the fixture; said first part having a disc with an eccentric second opening therethrough for axial rotation relative to the casing of the first part to align the second opening with the first opening in the said casing so that the shank can pass through the so aligned openings for operation of the device, said disc being rotatable to permit access to said fastening means for securing the first part to said fixture but prevented from rotation to permit such access when the said shank is positioned to extend through said aligned first and second openings and latched.

3. A locking device as claimed in claim 2 wherein said latch is key actuatable and includes a lever which is pivotal by key freed actuation to engage the free end of said shank to prevent withdrawal of the shank from the first part.

4. A locking device as claimed in claim 2 wherein said shank has a groove in its side surface which is engaged by the said lever, for effecting said engagement.

5. A locking device as claimed in claim 2 wherein a further opening is provided in said disc and is alignable, by said rotation of said disc, to permit selective access to screw holes in said casing for receiving said fastening means, but said disc covering said screw holes when said first and second parts are engaged.

6. A locking device as claimed in claim 2 wherein said second opening is alignable, by said rotation of said disc, to permit selective access to screw holes in said casing, for receiving said fastening means, but said disc covering said screw holes when said first and second parts are engaged.

7. A locking device comprising (a) a casing;

(b) said casing having a first opening and at least two screwholes therein;

(c) a rotatable disc mounted on said casing for axial rotation thereon;

(d) said rotatable disc having an eccentric second opening therethrough, said second opening being positioned so that rotation of said rotatable disc will enable alignment of said first and said second opening;

(e) an elongate shank having a free end and an enlarged head portion at the end opposite said free end, said free end being operative to pass through the trigger guard of a firearm and said second opening into said first opening when said first and second openings are aligned;

(f) latching means for releasably latching said elongate shank to said casing;

(g) said disc being rotatable to permit access to said screwholes; and (h) said disc being prevented from rotation when said shank extends through the aligned first and second openings.

* * * * *